United States Patent [19]

Mueller et al.

[11] 4,146,071

[45] Mar. 27, 1979

[54] POWER DRIVER FOR FASTENERS

[75] Inventors: Ralph Mueller, Frickenhausen; Heinz Schwarz, Nuertingen-Zizishausen, both of Fed. Rep. of Germany

[73] Assignee: Firma Karl M. Reich Maschinenfabrik GmbH, Nuertingen, Fed. Rep. of Germany

[21] Appl. No.: 832,792

[22] Filed: Sep. 12, 1977

[30] Foreign Application Priority Data

Sep. 17, 1976 [DE] Fed. Rep. of Germany ..... 2641828

[51] Int. Cl.[2] ..... B25B 23/04

[52] U.S. Cl. ..... 144/32 S; 29/813; 227/136

[58] Field of Search ..... 144/32; 227/95, 136; 29/429, 431, 432, 226, 240, 813; 221/71, 74

[56] References Cited

U.S. PATENT DOCUMENTS

| | | | |
|---|---|---|---|
| 2,009,580 | 7/1935 | Govanus | 227/136 |
| 2,923,937 | 2/1960 | Laucher | 227/136 |
| 3,550,831 | 12/1970 | Obergfell | 227/136 |
| 3,554,246 | 1/1971 | Halstead | 144/32 |
| 3,910,324 | 10/1975 | Nasiatka | 144/32 R |
| 3,930,297 | 1/1976 | Potucek et al. | 144/32 R X |
| 4,014,225 | 3/1977 | Lejdegard et al. | 144/32 R |

*Primary Examiner*—Donald R. Schran
*Assistant Examiner*—W. D. Bray
*Attorney, Agent, or Firm*—W. G. Fasse; D. F. Gould

[57] ABSTRACT

The present power driver handles fasteners of varying length mounted on a strip or belt, through a touch-down foot which accommodates fasteners of different length to eliminate wasted motion of the driver. The fasteners are also prevented by said touch-down foot from tipping or going into a workpiece at an angle. The depth to which the fasteners are driven into the workpiece is controllable and any irregularities in the mounting of the fasteners on the strip or belt are compensated.

6 Claims, 5 Drawing Figures

POWER DRIVER FOR FASTENERS

BACKGROUND OF THE INVENTION

This invention relates to a power driven apparatus for rapidly driving fasteners such as screws or the like; hereafter the apparatus will be referred to as a "driver". The screws or other fasteners are joined together in a continuous strip or belt. An automatic feed device is provided to continuously feed the fasteners to the driver. The feed device is actuated when the operator of the driver presses the driver against a workpiece.

A power driver of this type is known from German Patent Publication (DOS) No. 2,452,246, corresponding to U.S. Pat. No. 3,930,297; granted on Jan. 6, 1976. The power screw driver disclosed by this German Publication is provided with a foot with which the driver can be set down on a workpiece. The screws are held in the legs of a U-shaped holding belt which is moved into a recess of a bearing body. During the screwing-in the first screw in a strip is released from the holding belt and screwed into the workpiece. If the screw is released from the holding belt before the point of the screw has penetrated into the workpiece, it is possible for the screw to slant or tip at an angle. If the screw is at a slant it will either go into the workpiece crooked or it will jam. This difficulty can only be avoided if the point of the screw supplied to the driver is located as near as possible to the surface of the workpiece. However, with screws of different lengths the driving spike of the power driver in the rest position must be at least above the head of the longest screw. The disadvantage here is that with shorter screws an unproductive driving movement of the drive spike towards the workpiece is necessary until the drive spike engages in the head of the shorter screw.

From the above it may be seen that the driving stroke is always the same length both with short and long screws. This leads to an inefficient waste of time and energy with the shorter screws. On the other hand, if the screws supplied to the power driver are mounted in such a way that the heads of screws of different length are always located at the same height, then the points of the shorter screws are relatively far away from the workpiece. This gap between screw point and workpiece can mean that the shorter screws will take up a slanting position which leads to jamming or faulty fastening work.

In practice there are unavoidable differences in the lengths of the screws and also in the embedding of the screws in the holding belt. Either of these imperfections can result in the screw being released from the holding belt before the point of the screw has penetrated into the workpiece. Therefore, faulty screwing and jamming has always been a possibility with the prior art devices.

Attempts have been made to supply screws to the driver in such a way that their points are always located in the immediate vicinity of the surface of the workpiece. One method of doing this is to attach the screws very exactly to the holding belt. However, the high demands for accuracy in the manufacture of the holding belt and the insertion of screws onto the belt results in an increase in the costs of the production of the belt.

OBJECTS OF THE INVENTION

In view of the foregoing, it is the aim of the invention to achieve the following objects, singly or in combination:

to supply the fasteners to the driver in such a way that their points are located as close as possible to the workpiece before being driven;

to hold the fasteners in such a manner that they are driven into the workpiece in a perpendicular manner;

to construct a power driver so that fasteners of different length may be driven;

to avoid unproductive positioning movements of the power driver; and to provide for presetting of the depth to which the fasterners are driven.

SUMMARY OF THE INVENTION

This invention provides an improved power driver for fasteners joined together in a strip. The power driver has a housing supporting a drive motor attached to a drive spike. A guide sleeve is connected to the housing. A supporting body, also referred to as a bearing body, is mounted in the guide sleeve so that it can be displaced parallel to the long axis of the drive spike. Spring means are provided between the housing and the supporting body. A guide channel is provided through the bearing body of the power driver for feeding the strip or belt. A feed device is mounted on the supporting or bearing body to position the fasteners under the drive spike. The feed device is actuated by movement of the housing towards the bearing body.

According to the invention a touch-down foot is mounted on the bearing body. The touch-down foot, hereafter simply referred to as foot, is adjustably movable parallel to the long axis of the driving spike. This foot can be set exactly to the desired screw length so that the points of the screws are always located in the immediate vicinity of the surface of the workpiece. Therefore, when the screws are screwed in, their points penetrate reliably into the workpiece before the screws are released from the holding belt. In this way, faulty screwing and jamming of the screws is eliminated. The screws are supplied in such a manner to the power driver that the screw heads are always located directly beneath the driving spikes. This ensures that the driving spike engages in the heads of the screws with no idle stroke during the driving movement, whereby the length of time required to drive each fastener, such as a screw, is reduced.

The present apparatus drives the fasteners at their heads, whereby the holding belt may be arranged at any desired point along the shanks of the fasteners. This feature provides flexibility in the production of the strip or belt because the strip or belt can be adapted to suit the special conditions of the machine for producing the strip or belt. Further, it is not necessary to make the holding belt with particularly exact dimensions, so expedient and inexpensive manufacture of the holding belt is ensured.

The foot of the invention has an adjustment element and a displacement element which can be displaced relative to the adjustment element against the effect of a spring. The adjustment element is mounted on the bearing or supporting body so that it can be moved parallel to the long axis of the driving spike and can be fixed in position. In this way the foot may be conveniently adjusted for any length of screw to be driven. During the screwing process the displacement element can be moved upwards so that a conical recess in the foot encompasses the point of the screw that is following the screw which is being screwed in. In other words, the point of the screw next down the belt from the driven screw is encompassed. In this manner the strip is held firmly and securely during the screwing.

To suit different operating requirements such as particularly large workpieces or elastic coatings, the foot may be interchangeable. To adjust the screwing-in depth of the screw head the foot is fitted on its drive side with a slanting abutment surface. This abutment surface co-acts with a stop element mounted on the guide sleeve. The stop element can be displaced transverse to the long axis of the driving spike and can be fixed in position. This ensures that by the co-acting of the displacement element, the adjustment element and the slanting abutment surface that a constant screwing-in depth is obtained in all instances.

The present invention is illustrated with screw fasteners but it may also be used in driving nails, pins, star nails, dowels, and the like. If hammer action is desired, the drive spike is designed to carry out a to and fro movement, rather than a rotational screwing movement and may be driven either electrically or pneumatically by a suitable drive motor, as is well known in the art.

BRIEF FIGURE DESCRIPTION

In order that the invention may be clearly understood, it will now be described, by way of example, with reference to the accompanying drawings, wherein.

DETAILED DESCRIPTION OF PREFERRED EXAMPLE EMBODIMENTS

Figure 1:
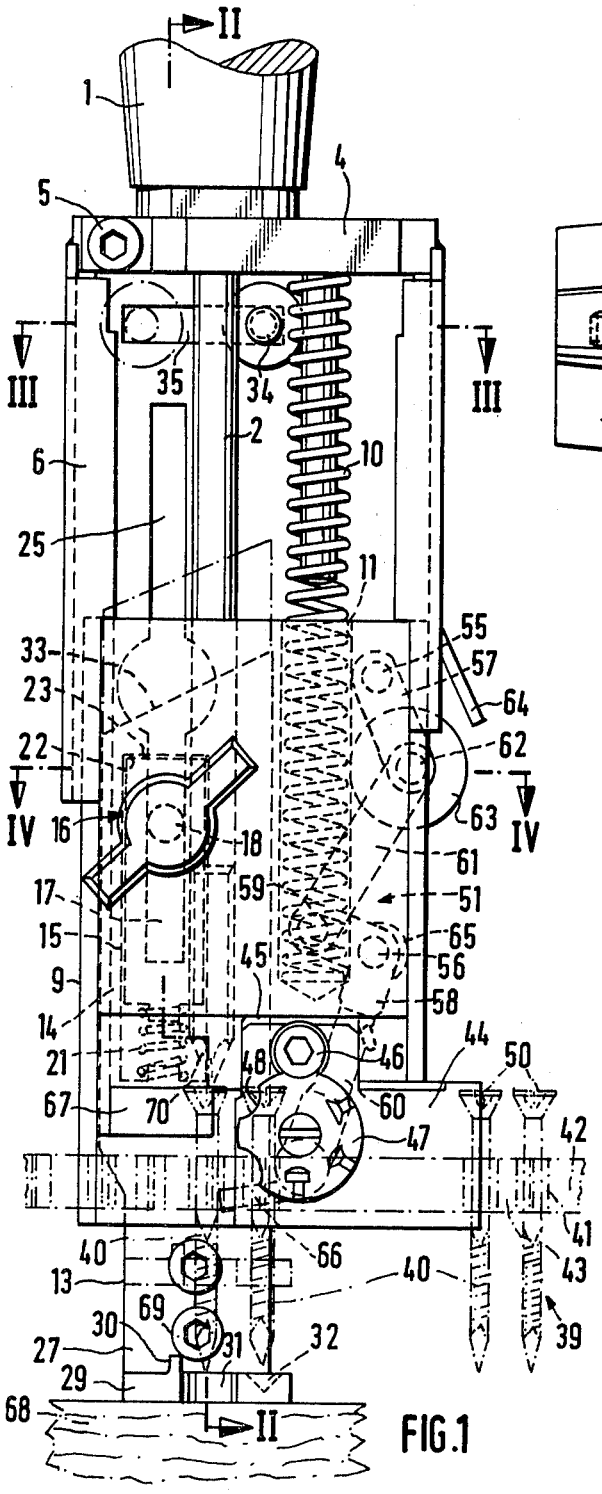
FIG. 1 is a front view of the power driver with interior parts shown in dashed lines.
Figure 2:
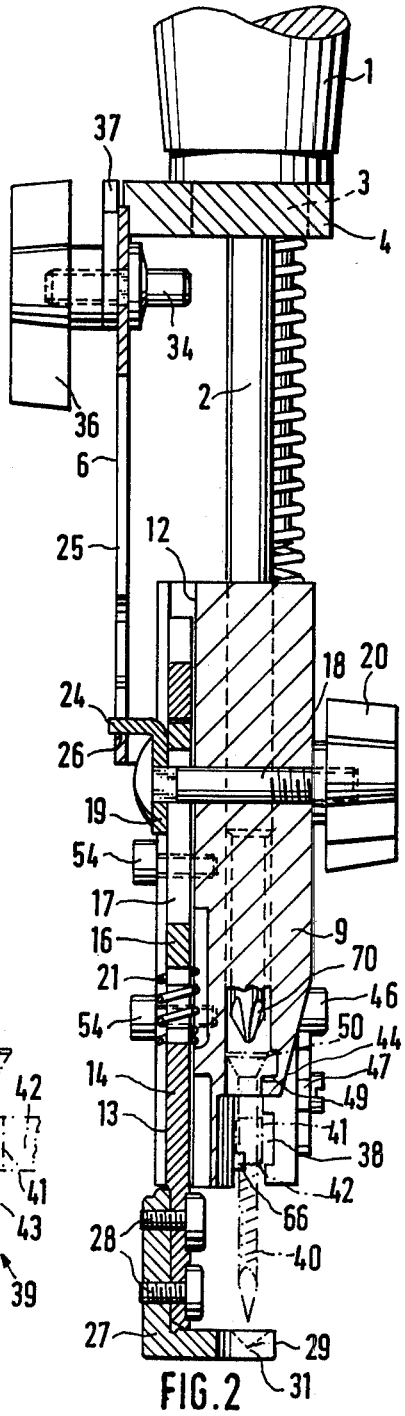
FIG. 2 is a longitudinal section along the line II — II in FIG. 1.
Figure 3:
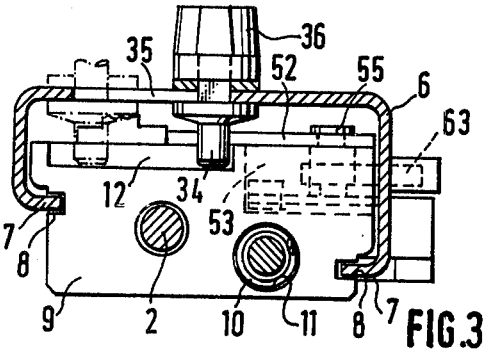
FIG. 3 is a cross-section of the invention along the line III — III in FIG. 1.
Figure 4:
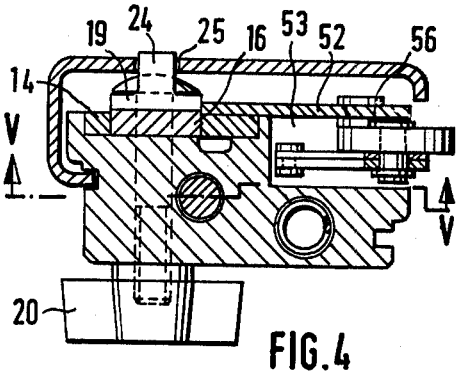
FIG. 4 is a second cross-section of the invention taken along the line IV — IV in FIG. 1.

In FIGS. 1 to 5 like parts bear the same reference numbers. Referring to FIG. 1, housing 1 supports conventionally a drive motor (not shown) for the driving spike 2. A guide sleeve 6 with a substantially C-shaped cross section is provided below the housing 1. The guide sleeve 6 is attached to the housing 1 by means of a securing boss 3 as best seen in FIG. 2. The guide sleeve 6 is attached to the securing boss 3 by means of a flange 4 and a screw 5 as best seen with reference to FIGS. 1 and 2. FIG. 3 shows that the guide sleeve 6 is provided with in-curving arms 7 which engage in grooves 8 which have been provided in a bearing or supporting body 9 which extends below the guide sleeve 6. In this way, the guide sleeve 6 can easily be displaced relative to the bearing body 9. A compression spring 10, (FIG. 1), is located between the bearing body 9 and the flange 4. A bore 11 extends in the bearing body 9 to receive the compression spring 10. A pocket 12 holding a touch-down foot 13 is provided in the bearing body 9. The foot 13 of the invention projects from the body 9 and can be displaced and adjusted relative to the body 9. The driving spike 2 projects downwardly from the housing 1. The foot 13 is displaceable and adjustable relative to the longitudinal axis of the driving spike 2.

The foot 13 includes a displacement element 14 which is movably and adjustably held in a pocket 12 of said supporting body 9 as best seen in FIG. 2. The displacement element 14 of the foot 13 has a rectangular aperture 15 as best seen in FIG. 1 for the displacing and adjusting of the foot 13. An adjustment element 16, as best seen in FIG. 2, is located inside of the aperture 15 which extends into the pocket 12. An elongated slot 17 is provided in the adjustment element 16. A clamping screw 18 is mounted in the supporting body 9 and extends through the slot 17. The clamping screw 18 is provided with a stop bracket 19 at one end thereof as shown in FIG. 2. The adjustment element 16 may be firmly clamped into an adjusted position against the bearing body 9 by means of said stop bracket 19 by tightening a winged nut 20 secured to a threaded end of the clamping screw 18.

A compression spring 21 is placed between the displacement element 14 and the adjustment element 16. The compression spring 21 is arranged in such a way that the displacement element 14 is pressed with its inner surface 22 against the upper end face 23 of adjustment element 16. The displacement element 14 is freely movable in the pocket 12 against the effect of the compression spring 21.

FIG. 2 illustrates a projection 24 in the stop bracket 19 and an elongated slot 25 in the guide sleeve 6. The projection 24 of the stop bracket 19 engages in the elongated slot 25 of the guide sleeve 6 and is pressed in the rest position of the invention by the force of the compression spring 10 against an inner surface 26 of the elongated slot 25.

FIG. 2 shows how a touch-down element 27 and screws 28 function as a detachable bracket for the foot 13. The element 27 forms the foot proper and is attached to the lower end of the touch-down foot 13. The element 27 has a stop projection 30 as best seen in FIG. 1 and a hole 31 best seen with simultaneous reference to FIGS. 1 and 2. A foot plate 29 is provided at the bottom of the element 27 and comprises stop projection 30 and the hole 31. The foot plate 29 is further provided with a conical recess 32. The wide end of the conical recess 32 points towards the drive motor. The function of the conical recess 32 is to temporarily hold the screw next in the belt adjacent to the screw underneath the driving spike 2. The co-action of the conical recess 32 and the foot 13 will be detailed later.

The foot 13 has a slanting abutment surface 33 on its upper end as seen in FIG. 1. A stop element 34 cooperates with the slanting abutment surface 33 of the foot 13. An elongated slot 35 in the guide sleeve 6 runs transverse to the long axis of the drive spike 2. A wing nut 36 locks the stop element 34 in the desired position in slot 35. This enables the stop element 34 to engage the slanting abutment surface 33 of the foot 13 at the desired point. An indicator plate 37 is connected to the stop element 34 and a scale (not shown) is attached to the flange 4. The indicator plate 37 enables the operator of the power driver to read the screwing-in depth off the scale attached to the flange 4.

FIG. 2 shows a transverse guide channel 38 in the lower part of the body 9. This lower part of the body 9 is referred to as the touch-down side. A plurality of screws 40 are held in a strip 39. The strip has channels 41 designed to receive the screws 40, and webs 43 connecting the screw channels. The screws 40 are embedded by their threads in the web channels 41. The guide channel 38 for the screws is closed or confined by a cover plate 44 which is fixed in a pocket 45 which has been provided in the body 9. A locking screw 46 enables positioning the cover plate 44 at various heights or levels. A rotatable adjustment disc 47 cooperates with the cover plate 44 and the screw 46. The rotatable adjustment disc 47 has a plurality of semi-circular cut-outs such as cut-out 48. The three illustrated cut-outs on the circumference of the rotatable adjustment disc 47 are cut to various depths to serve as a stop for the screw 46. FIG. 1 shows that the rotatable adjustment disc 47 is attached to the cover plate 44 having an abutment edge 49 projecting into the guide channel 38 as best seen in FIG. 2. This abutment edge 49 can be displaced parallel to the long axis of the driving spike 2 so that screws 40 with their heads held in the web 43 at various levels may be guided reliably in the guide channel 38. This also applies where the screw heads have different heights.

Figure 5:
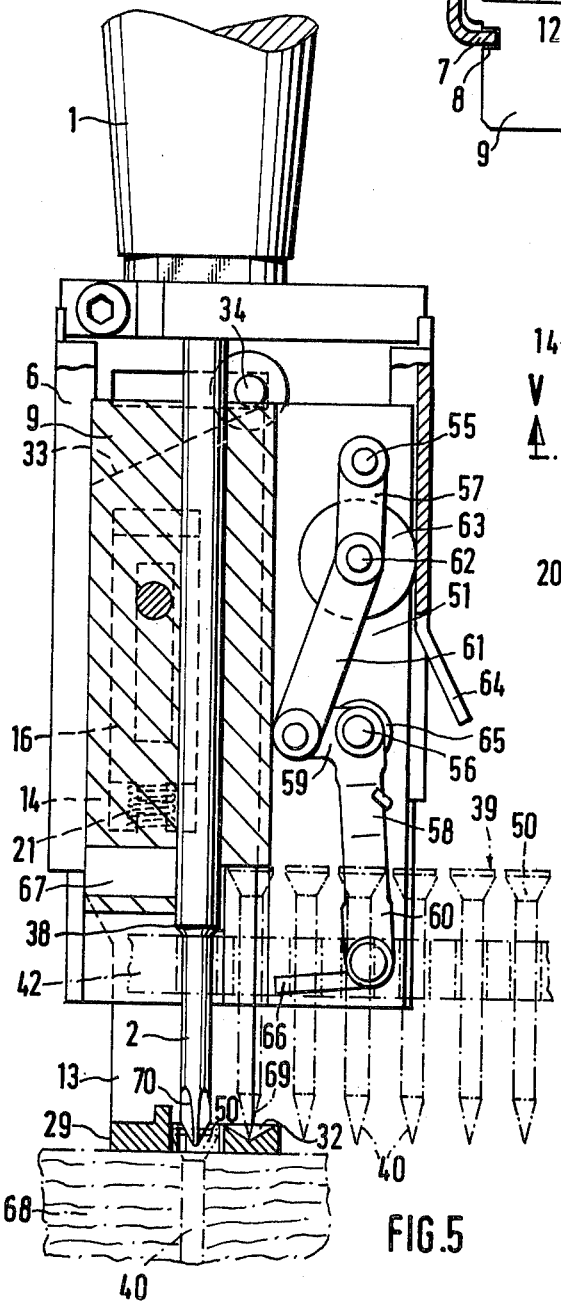
FIG. 5 is a longitudinal section along line V — V in FIG. 4 with the housing in the driving position and the feed device in the held back position.

As best seen in FIGS. 1 and 5 a fastener feed device 51 is positioned to supply a screw (FIG. 1) while in FIG. 5 the feed device 51 is in a held back position. A recess 53 and a supporting plate 52 are provided inside of the guide sleeve 6. The feed device 51 is mounted on the supporting plate 52 in such a way that it reaches into the recess 53 in the body 9. Two screws 54 connect the supporting plate 52 to the body 9 so that the supporting plate 52 can be detached easily. The supporting plate 52 has two pins 55 and 56 which are used to suspend the feed device 51 from the supporting plate 52. The feed device 51 has a link 57 attached to the pin 55 and an angle lever 58 with arms 59 and 60 rotatably attached to the pin 56. Another link 61 pivotally connects the free end of the link 57 and the arm 59 of the angle lever 58. A pin 62 connects the links 57 and 61 together. A roller 63 is rotatably mounted on the pin 62. A slanting actuating plate 64 is rigidly connected to the guide sleeve 6. The function of the actuating plate 64 is to engage the roller 63 to actuate the feed device 51. An operating lever spring 65 is journalled on the pin 56. The operating lever spring 65 exerts a force in the clockwise direction on the arm 60 of the angle lever 58. On the free end of the arm 60 there is provided a feed finger 66, the free end of which projects into the guide channel 38 as best seen in FIG. 2.

A permanent magnet 67 is secured to the body 9 at the left hand end of the guide channel 38. This permanent magnet 67 securely holds the first screw 40 lying in the guide channel 38.

The present power driver operates as follows: FIG. 1 shows the power driver in the rest position with the foot plate 29 resting on a workpiece 68 into which the first screw 40 is to be screwed. The foot 13 is now in the position drawn in full lines so that the distance between the drive side surface of the foot plate 29 and the tip 69 of the screw 40 amounts to 2–3mm. The screw tips 69 are so located as to be freely movable over the foot plate 29. If now, the drive motor (not shown) for driving the spike 2 is switched on, the housing 1 presses in the direction of the workpiece 68. The compression spring 10 acts on the body 9 so that the body 9 is also moved in the direction of the workpiece 68. The screws 40 which are already in the guide channel 38 are thereby taken down in the direction of the workpiece 68 until the screw following the screw to be screwed into the workpiece rests with its tip 69 in the recess 32 as seen in FIG. 5. The compression spring 21 between the adjustment element 16 and the displacement element 14 is also compressed by a set amount during this downward movement.

As the housing 1 presses on further downwardly toward the workpiece 68, the body 9 is prevented by the second screw in the belt as measured from the left in FIG. 5 from further movement. This second screw, however, is firmly clamped between the body 9 and the foot plate 29 so that the strip of screws is also securely held. With further pressing on movement, the driving spike 2 engages with its point 70 a corresponding cut-out in the head 50 in the first screw of the strip. The first screw of the strip rotates in the belt web channel 41, thereby moving in the direction of the workpiece 68. The pressing on movement is continued until the stop element 34 strikes the sloping abutment surface 33 of the foot 13. Then the screw is released completely from the web channel 41 and is screwed into the workpiece 68 in such a way that the head 50 of the screw 40 takes up the desired position in the surface of the workpiece 68.

The action of the screw feed mechanism 51 will be described with reference to FIG. 5, wherein the actuating plate 64 has pushed down over the roller 63 so that the roller 63 is forced in the direction of the driving spike 2. The roller 63 takes the links 57 and 61 along with it. The links 61 pivots the angle lever 58 against the effect of the lever spring 65 in a counterclockwise direction. The feed finger 66 thus arrives behind the screw which is the second screw from the left in the strip of screws.

After the housing 1 has been drawn back, the actuating plate 64 releases the roller 63 again as best seen in FIG. 1. The lever spring 65 now pivots the angle lever 58 in the clockwise direction. In this rest position of the power driver the foot 13 is forced by the compression spring 21 out of the body 9 so that the foot plate 29 releases the point of the screw that was held in recess 32. The finger 66 can now move the strip of nails in the guide channel 38 until the next screw lines up with the now withdrawn drive spike 2. The head of the first screw as measured from the left in FIG. 1 is securely held by the permanent magnet 67. The power driver is now ready for the next driving sequence.

If, as shown in FIG. 1, shorter screws are to be driven, the winged nut 20 is released and the foot 13 is moved in the direction of the housing 1. This locates the foot plate 29 directly under the points of the screws 40. This ensures that these points are again located directly over the surface of the workpiece 68 when the foot plate 29 is set thereon. The position of the foot 13 for short screws is shown by dashed lines in FIG. 1.

In practice it is desired to drive the screws in such a manner that their heads lie either raised above, level with, or countersunk in the surface of the workpiece 68. This desired depth of screwing is obtained by horizontal movement of the abutment or stop element 34. The abutment or stop element 34 which is shown in full lines in FIG. 3 takes up a position so that the screw head 50 takes up a raised above position on the workpiece 68 as seen in FIG. 5.

With the position of the abutment or stop element 34 shown in dashes in FIG. 3, the screw head is countersunk into the workpiece by the maximum amount.

Although the invention has been described with reference to specific example embodiments, it will be appreciated that it is intended to cover all modifications and equivalents within the scope of the appended claims.

What is claimed is:

1. An apparatus for automatically power driving fasteners such as screws or the like which are joined together in a strip, comprising housing means, power drive means operatively supported by said housing means, driving spike means operatively connected to said power drive means and defining a longitudinal axis, guide means connected to the housing means, supporting body means movably mounted in the guide means for displacement parallel to the axis of said driving spike means, spring means operatively connected to said supporting body means for biasing said supporting body means against said displacement, guide channel means for said fastener strip extending through said supporting body means, fastener feed advance means mounted in said supporting body means and actuated by movement between said housing means and said supporting body means, touch-down foot means, and means mounting said touch-down foot means to said supporting body means for displacement and adjustment of said touch-down foot means parallel to said longitudinal axis of said driving spike means, said touch-down foot means properly guiding said fastener.

2. The apparatus of claim 1, wherein the touch-down foot means comprise adjustment means, displacement means and spring means operatively interposed between the adjustment means and the displacement means, whereby the displacement means is displaceable relative to the adjustment means against the force of said spring means, said adjustment means being mounted on the supporting body means for displacement parallel to the longitudinal axis of the driving spike means, and means for securing the adjustment means in an adjusted position.

3. The apparatus of claim 2, wherein said touch-down foot means comprises a touch-down element having a conical recess in its surface facing said supporting body means.

4. The apparatus of claim 1, comprising means operatively securing said touch-down foot means to said displacement means in a releasable and interchangeable manner.

5. The apparatus of claim 1, wherein the touch-down foot means comprises a slanting abutment surface, said apparatus further comprising abutment means mounted on said guide sleeve means for displacement transverse to the axis of said driving spike means and means for arresting said abutment means in a predetermined position, said abutment means cooperating with said slanting abutment surface of said touch-down foot means.

6. The apparatus of claim 1, further comprising a cover plate mounted on said supporting body means and confining said guide channel means, said cover plate having an adjustable abutment edge for the heads of said fasteners.

* * * * *